US005552218A

United States Patent [19]

Maat et al.

[11] Patent Number: 5,552,218

[45] Date of Patent: Sep. 3, 1996

[54] POLYKETONE YARN AND A METHOD OF MANUFACTURING SAME

[75] Inventors: Hendrik T. Maat, Rijssen; Peter J. Cloos, Duiven; Harm Van Der Werff, Ede; Bert J. Lommerts, Dieren, all of Netherlands

[73] Assignee: Akzo Nobel N.V., Arnhem, Netherlands

[21] Appl. No.: 360,703

[22] PCT Filed: Jun. 21, 1993

[86] PCT No.: PCT/EP93/01586

§ 371 Date: Dec. 21, 1994

§ 102(e) Date: Dec. 21, 1994

[87] PCT Pub. No.: WO94/00623

PCT Pub. Date: Jan. 6, 1994

[30] Foreign Application Priority Data

Jun. 26, 1992 [NL] Netherlands ..... 9201141

[51] Int. Cl.[6] ..... D02G 3/00

[52] U.S. Cl. ..... 428/357; 428/364; 428/394; 568/303

[58] Field of Search ..... 568/303; 428/357, 428/364, 394

[56] References Cited

FOREIGN PATENT DOCUMENTS

| | | | |
|---|---|---|---|
| 0121965A2 | 10/1984 | European Pat. Off. | C08G 67/02 |
| 0222454B1 | 5/1987 | European Pat. Off. | C08G 67/02 |
| 0229408B1 | 7/1987 | European Pat. Off. | C08G 67/02 |
| 0227135B1 | 7/1987 | European Pat. Off. | C08G 67/02 |
| 0228733A1 | 7/1987 | European Pat. Off. | C08G 67/02 |
| 0239145B1 | 9/1987 | European Pat. Off. | C08G 67/02 |
| 0235865A2 | 9/1987 | European Pat. Off. | C08G 67/02 |
| 0235866A2 | 9/1987 | European Pat. Off. | C08G 67/02 |
| 0246683A2 | 11/1987 | European Pat. Off. | C08G 67/02 |
| 0245893A2 | 11/1987 | European Pat. Off. | C08G 67/02 |
| 0246674B1 | 11/1987 | European Pat. Off. | C08G 67/02 |
| 0248483B1 | 12/1987 | European Pat. Off. | C08G 67/02 |
| 0254343A1 | 1/1988 | European Pat. Off. | C08G 67/02 |
| 0253416A1 | 1/1988 | European Pat. Off. | C08G 67/02 |
| 0259914B1 | 3/1988 | European Pat. Off. | C08G 67/02 |
| 0257663B1 | 3/1988 | European Pat. Off. | C08G 67/02 |
| 0264159B1 | 4/1988 | European Pat. Off. | C08G 67/02 |
| 0262745A2 | 4/1988 | European Pat. Off. | C08G 67/02 |
| 0263564B1 | 4/1988 | European Pat. Off. | C08G 67/02 |
| 0272728B1 | 6/1988 | European Pat. Off. | C08G 67/02 |
| 0277695B1 | 8/1988 | European Pat. Off. | C08G 67/02 |
| 0360358A3 | 3/1990 | European Pat. Off. | D01F 6/30 |
| 0456306A1 | 11/1991 | European Pat. Off. | D01F 6/30 |
| 90/14453 | 11/1990 | WIPO | D01F 6/30 |

*Primary Examiner*—N. Edwards

*Attorney, Agent, or Firm*—Joseph M. Noto; Loretta A. Miraglia; Louis A. Morris

[57] ABSTRACT

The invention relates to polyketone yarns of which the maximum tangential modulus at an elongation of more than 0.2% is at least 10 N/tex which display both high strength and, if so desired, a high elongation at break. The quality number, which is measured on a single filament out of a bundle of at least about 30 filaments spun simultaneously through one spinneret and given as $\sigma.\epsilon$, is higher than 85 mN/tex, preferably higher than 100 mN/tex. The quality number of a yarn spun through one spinneret of one or more holes is higher than 110 mN/tex, preferably higher than 120 mN/tex. The yarns are manufactured by extruding a solution of a linear polymer of alternating ethylene and carbon monoxide units in a resorcinol-containing solvent, after which the solvent is removed with the aid of methanol as coagulant.

7 Claims, No Drawings

POLYKETONE YARN AND A METHOD OF MANUFACTURING SAME

The invention relates to a yarn of a linear polymer of alternating ethylene and carbon monoxide units of which the maximum tangential modulus at an elongation of more than 0.2% is at least 10N/tex, and a process for making such yarns.

BACKGROUND OF THE INVENTION

Single filament yarns of this type are disclosed in International Patent Application WO 90/14453. The maximum modulus of the polyketone yarns described in said document generally is satisfactory. Also, some yarns of satisfactory tenacity are described. However, the elongation at break of yarns which possess such satisfactory tenacity is low, as a result of which the yarns are not always suitable for application in industry. The yarns described in this application which do have sufficient elongation at break are substantially less strong, so that, generally speaking, it can be argued that the overall quality of the yarns according to this document is found insufficient for every practical application.

Yarns of the type mentioned in the opening paragraph are also disclosed in EP-A-456 306. In this document, a yarn of good overall quality is described. However, the yarn is obtained by spinning through 6 capillaries, which means that the yarn is comprised of 6 filaments spun simultaneously. Such a slender yarn is not suitable for industrial practice.

SUMMARY OF THE INVENTION

In the present document, with a yarn both single filament yarns and multifilament yarns are meant. Polyketone yarns have now been found which exhibit very favourable properties in both of these respects, i.e., yarns of good tenacity also have the desired comparatively high elongation at break. The yarns of the very favourable quality now found can be prepared in a highly economical manner, viz. by spinning more than 30 filaments simultaneously through one spinneret. It is well-known that by spinning a yarn through a capillary comprising more than a few spinning holes, say 30 holes or more, the physical properties of the yarn will be considerably less than the yarn obtained by spinning through one or just a few spinning holes, especially when spinning at practical conditions.

The invention now consists in that the quality number according to the formula $\sigma.\epsilon$ of the yarn of the type mentioned in the opening paragraph is higher than 85 mN/tex and the yarn comprises at least 30 filaments which are spun simultaneously through one spinneret. In the formula $\sigma.\epsilon$, $\sigma$ stands for the tenacity of the yarn measured on a single filament and is expressed in mN/tex, while $\epsilon$ stands for the elongation at break, which is expressed as the ratio of the length of one filament at break to that of one filament in the unloaded state, minus 1.

It is known that the tenacity of the end product may be augmented by drawing the spun yarns. Such a process, however, always shows a marked decrease of the elongation at break.

In the making of the yarns according to the present invention, increased tenacity resulting from drawing of the yarns will likewise be attended with a decrease of the elongation, though to a significantly less marked degree than was the case according to the prior art. At virtually any draw ratio, the yarns found proved to have a higher quality number than was the case for the hitherto known products. Notably yarns of which the quality number is higher than 90 mN/tex more particularly higher than 100 mN/tex, and which comprise at least 30 filaments spun simultaneously through one spinneret, have proved highly suitable for a wide range of industrial applications. Also yarns have been found which have a quality number higher than 110 mN/tex. Preferably, the yarns according to the invention have a quality number higher than 120 and 130 mN/tex, more preferably higher than 140 mN/tex. Such very good quality yarns were not obtained before, not even when the yarn was spun through a spinneret having one single capillary. Accordingly, also found are yarns with a maximum tangential modulus at an elongation of more than 0.2% of at least 10 N/tex, which may be spun through a spinneret having any number of spinning holes such as one spinning hole, and have a quality number higher than 110 mN/tex, and preferably higher than 120 mN/tex. In a preferred embodiment, such yarns have a quality number of over 140 mN/tex, even more preferably of over 160, 180 or even over 210 mN/tex. The high quality of the newly found yarns is also evident from the comparatively high maximum tangential modulus at a quality number over 85 mN/tex. Thus, the maximum tangential modulus may exceed 12 N/tex, 20N/tex, 25N/tex, and even 30N/tex at the quality numbers just given.

DETAILED DESCRIPTION OF THE INVENTION

The polymer of the type mentioned in the opening paragraph is also referred to as poly(ethytene ketone), poly(ethylene-alt-carbon monoxide), or polyketone. In addition to carbon monoxide and ethylene units, this polymer may contain a small quantity of other units. For instance, propylene groups may be incorporated into the polymer chains to affect the various properties of the polymer and the yarns spun therefrom. Also, small quantities of other substances may be admixed, e.g. to enhance thermal and/or oxidative resistance and/or other polymer and/or yarn properties. The polymer employed in preparing the yarns according to the invention contains at the most 15% of non-ethylene groups. Preferably, the polymer will contain less than 7% of non-ethylene groups. For the preparation of polyketone polymers reference is made to, int. al., European Patent Specifications 121 965; 222 454; 227 135; 228 733; 229 408; 235 865; 235 866; 239 145; 245 893; 246 674; 246 683; 248 483; 253 416; 254 343; 257 663; 259 914; 262 745; 263 564; 264 159; 272 728; and 277 695.

Yarns of the type mentioned in the opening paragraph are prepared as follows: the aforementioned polymer is dissolved in an appropriate solvent and the resulting solution extruded, after which the solvent is removed with the aid of a coagulant. Resorcinol in particular was found to be a suitable solvent. Such a process is also described in EP-A-456 306, which patent application discloses the preparation of a polyketone yarn using acetone as coagulant. However, when a plurality of filaments is spun from the polymer solution simultaneously, sticking of the filaments will quickly occur. Hence, the use of acetone is attended with a detrimental restriction of the number of filaments per yarn that can be spun. Such sticking also cuts down the extrusion rate. In addition, yarns spun and coagulated in this manner were found to be less readily drawable. This is not only detrimental to the spinning rate to be attained; the properties of the ultimately obtained yarns, such as modulus and tensile strength, likewise remain unsatisfactory.

It has been found that yarns according to the invention can be manufactured without the aforementioned drawbacks occurring. According to this process, the aforementioned polyketone polymer is dissolved in a resorcinol-containing solvent, after which the solution is extruded and then coagulated using methanol as coagulant. It has been found that if methanol is employed as coagulant, spinning yarns by spinning a plurality of filaments simultaneously gives no, or hardly any detrimental sticking of these filaments. This means that yarns made up of the numbers of filaments requested in actual practice can be manufactured in an economically very advantageous manner. Thus yarns composed of 30 or 50 filaments can be spun simultaneously from one spinning solution. It has been found that, in principle, any desired number of filaments, e.g. 250, 500, or more, can be extruded through one spinneret simultaneously, without detrimental filament sticking occurring in the process. Subsequently, the filaments can be further processed in a manner known in itself. This process has also been found to be very favourable for manufacturing extrudates according to the prior art. Not only is the process very favourable, but also the fibres obtained with it show much better physical properties than the fibres spun by the processes known.

It should be noted that the use of methanol as coagulant is known from International Patent Application No. 9 014 453. However, in this document use is made of a spinning solution employing m-cresol as solvent. The drawback to m-cresol as solvent is its high toxicity and malodour, while it is also a comparatively expensive raw material and so a poor choice for application on an industrial scale. Furthermore, the polymer's solubility in m-cresol is comparatively low, so that only low polymer concentrations are spun satisfactorily in the spinning solution.

In addition to resorcinol, the solvent may contain other substances to improve the process or the yarns to be obtained. The solvent may for instance contain some propylene carbonate, acetone, methanol, or water. A favourable process is achieved when some water is present in addition to the resorcinol to prevent objectionable sublimation of the latter. The potential crystallisation temperature of the resorcinol is reduced by the presence of water, which benefits the yarns' processability. The solvent is preferably employed in a resorcinol:water mixing ratio in the range of 1:2 to 20:1, more particularly 1:1 to 9:1, preferably 2:1 to 5:1.

The polymer solution to be extruded preferably contains 1–55 wt. % of the polymer. A favourable process is obtained if a polymer solution containing 10–35 wt. % of polymer is employed. The resulting solution, which is easy to handle in practice, is then extruded through a spinneret plate with the desired number of orifices. The extrusion process is carried out at a temperature at which the solution is fluid and is preferably in the range of 20° to 140° C. Preference is given to processing at a temperature in the range of 50° to 125° C., more particularly 80° to 110° C.

The spinneret plate preferably has at least 30 spinning orifices. Preference is given to extrusion through a spinneret plate with a higher number of orifices. According to the process now found, extruding may be carried out through a spinneret plate having at least 200 spinning orifices, as a result of which it is possible not only to process a large quantity of polymer per unit of time, but also to obtain in one go yarns made up of a number of filaments such as is used in actual practice.

The extrudate which forms is passed through a methanol-containing coagulation bath to remove the solvent from the yarns. While the formed filaments may be passed through the coagulation bath immediately upon being extruded, it has been found that the presence of a small air gap between the spinneret plate and the coagulation bath will considerably facilitate carrying out the process described here. However, the use of such an air gap is not always essential but dependent on, int. al., the polymer solution concentration and coagulation bath temperature.

The extraction of the resorcinol-containing solvent from the formed extrudates proceeds substantially more rapidly using methanol than when known coagulants such as acetone are employed. As a result, the coagulation bath, which up to now was most unfavourably long and hence took up much plant space, may be shortened substantially. It was found that if the spun extrudates in the form of yarns are passed across a rotating shaft during coagulation, the filaments of the forming yarn will spread out across the shaft, giving more rapid coagulation.

It is preferred to wash the extrudate after coagulation and prior to drawing, in order to remove the last remaining solvent. Preference is given to methanol itself being used as washing medium. Since methanol washes out more quickly than acetone, the washing bath's length may be substantially shortened. Alternatively, water may be used as washing medium, as it already was in the case of acetone coagulation. However, since methanol washes out slightly more quickly than water, it is preferred. Besides, preference is given to the coagulant and the washing medium being the same.

It was found not to be necessary to remove the methanol coagulant from the extrudates by means of an additional treatment, since the low boiling point of the coagulant will ensure sufficient removal of it by means of evaporation during further processing. According to a very suitable process for making yarns, after coagulation the yarns are pre-drawn at room temperature. If there is also washing in a separate bath, this pre-drawing may be carried out either before or after the washing. Such pre-drawing has the advantage when applied of any sticking that may have occurred being eliminated practically completely. It should be noted that sticking which occurs during high-speed spinning cannot be eliminated by means of such pre-drawing when other well-known coagulants are employed.

Next, and preferably immediately after the coagulation bath treatment, the resulting yarns are drawn at elevated temperature in one or more steps. Pre-drawing allows the number of drawing steps at elevated temperature to be reduced, the advantage being that the yarn does not have to be exposed to elevated temperatures for such a long time. It has been found that the quality of yarns obtained by using methanol as coagulant can be further improved by drawing the yarns at increased temperature. Depending on the draw rate, the optimal draw temperature range may be set to obtain maximum drawing ratios.

In the case high molecular weight polymers, i.e. polymers having an intrisic viscosity higher than 3 are used, favourable results are obtained if the draw rate of the first drawing step is set in accordance with the outcome of the equations given at [1] and [2] below.

The draw rate for continuous processing is defined as the average draw rate, calculated by dividing the difference between the feeding rate and the discharge rate by length of which the elongation takes place (see equation [1]). This can be measured by use of, e.g., a high speed camera.

In the formula provided for determining the optimal draw rate in batch processing the yarn is drawn with the aid of a crosshead and, the elongation takes place by displacing the crosshead. The draw rate is then defined as the initial draw rate, to be calculated from equation [2], with the crosshead rate being the rate of displacement of the crosshead.

$$\text{continuous: } \frac{d\epsilon}{dt}_{\text{average}} = \frac{V_2 - V_1}{L} \quad [1]$$

$$\text{batch: } \frac{d\epsilon}{dt}_{\text{initial}} = \frac{d\frac{l_1 - l_0}{l_0}}{dt} = \frac{1}{l_0} \times \frac{dl_1}{dt} = \frac{V}{l_0} \quad [2]$$

wherein:

$V_1$ stands for the feeding rate (m/s), $V_2$ stands for the discharge rate (m/s), L stands for the length over which elongation takes place (m), $l_0$ stands for the length before drawing (m), $l_1$ stands for the length after drawing (m), V stands for the crosshead rate (m/s), $d\epsilon/dt$ is the draw rate (1/s).

The optimal drawing temperature range for the first step may be calculated from the following equations [3] and [4] wherein Tmax refers to the upper temperature limit (in K), Tmin refers to the lower temperature limit (in K), and $d\epsilon/dt$ refers to the draw rate:

$$\frac{1}{Tmax} = -38{,}6 \times 10^{-6} \times \ln d\epsilon/dt + \frac{1}{545} \quad [3]$$

$$\frac{1}{Tmin} = 39.7 \times 10^{-6} \times \ln d\epsilon/dt + \frac{1}{520} \quad [4]$$

The draw rate is generally in the range of 0.0015 $s^{-1}$ to 0.5 $s^{-1}$. Therefore, in general, good results are obtained if the temperature at the first drawing step is at least 225° C., and even better results are found at temperatures between 228° and 245° C. Preferably, the temperature at the first drawing step is between 228° and 235° C., a temperature of about 230° C. providing the best results.

It has been found that yarns obtained according to the found process exhibit a higher elongation at break at an even draw ratio and tenacity than could be achieved using the known processes. The elongation at break preferably is in the range of 5 to 10%, more particularly 6 to 9%, notably 6 to 8%.

Such yarns made according to the disclosed process were found to also have a high tensile strength. For instance, yarns may be obtained of which the filaments have a tensile strength of higher than 1800 mN/tex, measured as the average of ten individual filaments. It is possible to generate tensile strengths in excess of 1900 mN/tex, even 2000 mN/tex. The value of the initial modulus, i.e., the modulus measured at an elongation of 0.2%, also is very favourable. The filament yarns now found have an initial modulus of higher than 15N/tex, preferably higher than 20N/tex, and more particularly higher than 25N/tex, measured on a single filament.

The yarns obtained according to the present invention are especially highly suitable for reinforcing rubber articles such as car tires and conveyor belts, for use in woven and non-woven textiles and geotextiles, and for reinforcing roofing membranes. The now found yarns generally constitute a favourable alternative to industrial yarns such as nylon, rayon, polyester, and aramid. Alternatively, the yarns may be transformed into pulp. This polyketone pulp, admixed or not with other materials such as carbon yarns or pulp, glass fibres or pulp, cellulose fibres or pulp, and the like, is highly serviceable as reinforcing material for asbestos, cement, friction materials, and as a replacement material for asbestos. The yarns may further be used in, for instance, woven fabrics, optionally admixed with other materials or provided with a covering layer of PVC or bitumen or some other material. These yarns are highly suited to those applications in which impact resistance (ballistics) is of importance, such as bulletproof vests and helmets.

Below, the invention will be further illustrated with reference to examples. In these examples the intrinsic viscosity of the polymer is defined as the limit at which the concentration C of the polymer becomes zero, to give the equation $(t-t_0)/(C.t_0)$, wherein $t_0$ represents the through-flow time of the solvent and t is the through-flow time of the polymer-containing solution in a capillary viscometer at 25° C. m-cresol was used as solvent. The filament properties were measured on yarns conditioned at 20° C. and 65% relative humidity for at least 24 hours. The tenacity, elongation at break, initial modulus, and maximum modulius were obtained by breaking a single filament or a multifilament yarn on an Instron tester. The gauge length for single broken filaments was 10 cm. The results measured on 10 filaments were averaged. Every sample was elongated at a constant rate of extension of 10 mm/min.

The filament count, expressed in tex, was measured on the basis of functional resonant frequency (ASTM D 1577-66, Vol. 25, 1968) or determined microscopically. The tenacity, elongation, and initial modulus as defined in ASTM D 2256-88, published April, 1988, were obtained from the load-elongation curve and the measured filament count.

The maximum tangential modulus was determined as the maximum angle of inclination of the stress-strain curve for elongation in excess of 0.2%.

The tenacity and moduli are expressed in mN/tex and N/tex.

Example I

Polyketone with an intrinsic viscosity of 5.0 dl/g was dissolved in a solvent containing resorcinol and water in a ratio of 3:1 until a solution containing 15 wt. % of polymer was obtained. This solution was extruded at a temperature of 38° C. through a spinneret with 250 spinning orifices of 80 μm in diameter, at a rate of 131 mm/s. Via a narrow air gap the extrudate was passed to a coagulation tube filled with cold methanol. After coagulation, the obtained yarn was passed through a methanol-containing washing bath, after which it was wet-wound. After drying at 100° C. the yarn was drawn in four steps in between successive heating areas of 230°, 245°, 256°, and 263° C. The draw rate of the first step was 0.16 $s^{-1}$, the deformation took place over a range of 60 mm. The total draw ratio was 16.7.

The tensile strength of the obtained multifilament yarn was $1.65 \times 10^3$ mN/tex, the elongation at break 5.7%. The initial modulus was 19.2N/tex, and the maximum modulus at an elongation of more than 0.2% was 35.6N/tex. The filaments of the multifilament yarn did not exhibit sticking. The quality number was 93.9 mN/tex.

Example II

Polyketone with an intrinsic viscosity of 4.5 dl/g was dissolved in a weight percentage of 20% in the solvent according to Example I. The resulting solution was extruded at a temperature of about 88° C. through 30 spinning orifices of 100 μm in diameter, at a rate of 135 mm/s. Following extrusion, the procedure was as described in Example I. The temperature of the heating areas was 232°, 246°, 253°, and 263° C., respectively, the draw rate of the first drawing step was 0.16 $s^{-1}$, the deformation took place over a length of 60 mm. The total draw ratio was 17.1. The tensile strength of the obtained yarn was $2\times10^3$ mN/tex, the elongation at break 6.6%. The initial modulus was 23N/tex, the maximum modulus 36N/tex. The filaments of the resulting product did not exhibit sticking or discolouration. The quality number was 132.7 mN/tex.

Example III

Polyketone with an intrinsic viscosity of 4.5 dl/g was dissolved in the solvent according to Example II in a weight percentage of 15%. This solution was extruded at 88° C. through a spinneret of 30 spinning orifices of 100 μm in diameter, at a rate of 135 mm/s, the extrudate falling via a narrow air gap to a coagulation tube filled with cold methanol. After coagulation, the obtained yarn was passed through a methanol-containing washing bath. After drying the yarn was drawn, the draw ratio being indicated below. For the draw ratio's of more than 9, the draw rate in the first step was 0.14 $s^{-1}$. The draw temperatures were the same as those given in Example II.

The values found are listed below. $E_1$ in this case represents the initial modulus, $E_2$ the maximum tangential modulus.

| Draw ratio DR | σ (mN/tex) | ε | $E_1$ (N/tex) | $E_2$ (N/tex) | σ·ε (mN/tex) |
|---|---|---|---|---|---|
| 4.03 | 417 | 0.237 | 2.5 | 2.7 | 98.8 |
| 9.52 | 970 | 0.096 | 4.9 | 12.2 | 93.1 |
| 11.04 | 1160 | 0.080 | 6.3 | 17.7 | 92.8 |
| 11.98 | 1270 | 0.070 | 7.87 | 22.4 | 88.9 |
| 12.97 | 1350 | 0.074 | 12.4 | 22.2 | 99.9 |
| 14.03 | 1480 | 0.074 | 13.9 | 23.8 | 109.5 |
| 15.01 | 1560 | 0.069 | 16.2 | 26.7 | 107.6 |
| 16.04 | 1640 | 0.067 | 16.2 | 29.5 | 109.9 |
| 17.00 | 1680 | 0.064 | 17.4 | 30.6 | 107.5 |
| 18.03 | 1620 | 0.056 | 19.6 | 34.2 | 90.7 |
| 19.00 | 1580 | 0.054 | 19.8 | 34.6 | 85.3 |
| 19.97 | 1440 | 0.049 | 19.9 | 34.8 | 70.6 |

Example IV

Polyketone with an intrinsic viscosity of 5 dl/g was dissolved in the solvent according to Example I in a weight percentage of 15%. This solution was extruded at a temperature of 82° C. through a spinneret with 30 spinning orifices of 100 μm in diameter, at a rate of 172 mm/s. Via a narrow air gap the extrudate was passed to a coagulation tube filled with methanol of 9° C. After coagulation, the obtained yarn was passed through a methanol-containing washing bath, after which it was wet-wound. After drying at 100° C. the yarn was drawn batchwise at different draw rates. The temperature was determined at which the maximum draw ratio was obtainable at a given draw rate. Accordingly, at a draw rate of 10% per minute, the maximum draw ratios was obtained at 204° C., at 100% per minute at 224° C., at 316% per minute at 237° C. and at 1000% per minute at 248° C.

The filaments of the yarn obtained were drawn till a draw ratio of about 25 was obtained. The results are indicated under A, B and C Example IV A At a draw rate of 100% per minute at a draw temperature of 215° C., a yarn having a tensile strength of $2.84\times10^3$ mN/tex and an elongation at break of 4.79 was found. The initial modulus was 47.8N/tex and the maximum modulus at an elongation of more than 0.2% was 66.7N/tex. The filaments of the multifilament yarn did not exhibit sticking. The quality number was 136 mN/tex. At a draw rate of 100% per minute it was not possible to draw the filament to a draw ratio of over 20 at a temperature of 230° C.

Example IV B

At a draw rate of 316% per minute at a draw temperature of 230° C., a yarn having a tensile strength of 3000 mN/tex and an elongation at break of 7.14 was found. The initial modulus was 33,8N/tex and the maximum modulus at an elongation of more than 0.2% was 42,8N/tex. The filaments of the multifilament yarn did not exhibit sticking. The quality number was 214 mN/tex.

Example IV C

At a draw rate of 1000% per minute at a draw temperature of 230° C., a yarn having a tensile strength of $214\times10^3$ mN/tex and an elongation at break of 4.98 was found. The initial modulus was 36,3N/tex and the maximum modulus at an elongation of more than 0.2% was 48,7N/tex. The filaments of the multifilament yarn did not exhibit sticking. The quality number was 106 mN/tex.

Comparative Example

Polyketone with an intrinsic viscosity of 4.5 dl/g was dissolved in the solvent according to Example I in a weight percentage of 17.5%. The extrusion rate was 273 mm/s, with acetone being employed as the coagulant and washing medium. The yarn was drawn in two steps in between successive heating areas of 231°, 242°, and 255° C., respectively, up to a draw ratio of 13.4 times, i.e., it was drawn to the greatest possible extent. Analysis of the residual concentration of solvent in the spun filaments showed that under otherwise identical spinning conditions, coagulation in methanol yielded a residual concentration after coagulation which was about 8 times lower than for coagulation in acetone.

The tensile strength of the obtained multifilament yarn was $0.7\times10^3$ mN/tex, the elongation at break 5.2%. The initial modulus was 10N/tex, and the maximum modulus at an elongation of more than 0,2% was 16.5N/tex. Inextricable sticking of the yarn filaments was found. It was found that drawing could be carried out only in two steps, since the yarn turned brown when heated for the second time and melted during the third step. The quality number was 34.9 mN/tex.

These tests show that even when working under less than optimal conditions, the properties of the obtained yarns are still significantly superior to those obtained when acetone is employed. It was also found in all cases that the fibres coagulated with methanol did not exhibit sticking after the first drawing step, which was in contrast to the findings for acetone being used. Furthermore, the time required for removing the resorcinol was found to be substantially shorter in those cases where methanol was used as coagulant and washing agent.

We claim:

1. A yarn comprising a linear polymer of alternating ethylene and carbon monoxide units, wherein the yarn is spun in a single step, the yarn has a maximum tangential modulus, at an elongation of more than 0.2%, of at least 10 N/tex, the yarn has a quality number, according to the formula σ.ε, higher than 85 mN/tex and the yarn comprises at least 30 filaments which are spun simultaneously through one spinneret.

2. The yarn of claim 1 wherein the quality number is higher than 100 mN/tex.

3. The yarn according to claim 2 wherein the quality number is higher than 120 mN/tex.

4. A yarn comprising a linear polymer of alternating ethylene and carbon monoxide units wherein the yarn has a maximum tangential modulus, at an elongation of more than 0.2%, of at least 10N/tex and the yarn has a quality number, according to the formula $\Gamma.\epsilon$, higher than 110 mN/tex.

5. The yarn according to claim 4 wherein the quality number is higher than 120 mN/tex.

6. The yarn according to claim 5 wherein the quality number is higher than 140 mN/tex.

7. The yarn according to claim 6 wherein the quality number is higher than 180 mN/tex.

* * * * *

UNITED STATES PATENT AND TRADEMARK OFFICE

CERTIFICATE OF CORRECTION

PATENT NO. : 5,552,218

DATED : September 3, 1996

INVENTOR(S) : Hendrik T. Maat, et al.

It is certified that error appears in the above-indentified patent and that said Letters Patent is hereby corrected as shown below:

Column 5, equation [4]

" $\frac{1}{Tmin} = 39.7 \times 10^{-6} \times \ln d\varepsilon/dt + \frac{1}{520}$ " should read -- $\frac{1}{Tmin} = -39.7 \times 10^{-6} \times \ln d\varepsilon/dt + \frac{1}{520}$ --

Column 9, line 9,

". . . to the formula $\Gamma.\varepsilon$, higher than . . ." should read

--. . . to the formula $\sigma.\varepsilon$, higher than . . .--

Signed and Sealed this

Twenty-first Day of January, 1997

*Attest:*

Bruce Lehman

BRUCE LEHMAN

*Attesting Officer*

*Commissioner of Patents and Trademarks*